US009410547B2

(12) United States Patent
Toyama et al.

(10) Patent No.: US 9,410,547 B2
(45) Date of Patent: Aug. 9, 2016

(54) COMPRESSOR WITH OIL SEPARATOR AND REFRIGERATION DEVICE INCLUDING THE SAME

(75) Inventors: Toshiyuki Toyama, Sakai (JP); Takashi Uekawa, Sakai (JP)

(73) Assignee: Daikin Industries, Ltd., Osaka (JP)

( * ) Notice: Subject to any disclaimer, the term of this patent is extended or adjusted under 35 U.S.C. 154(b) by 982 days.

(21) Appl. No.: 13/575,482

(22) PCT Filed: Jan. 27, 2011

(86) PCT No.: PCT/JP2011/051618

§ 371 (c)(1),
(2), (4) Date: Jul. 26, 2012

(87) PCT Pub. No.: WO2011/093385

PCT Pub. Date: Aug. 4, 2011

(65) Prior Publication Data

US 2012/0297818 A1 Nov. 29, 2012

(30) Foreign Application Priority Data

Jan. 27, 2010 (JP) ..... 2010-015715

(51) Int. Cl.
*F25B 43/02* (2006.01)
*F04C 18/02* (2006.01)
(Continued)

(52) U.S. Cl.
CPC ..... *F04C 18/0215* (2013.01); *F04B 39/023* (2013.01); *F04B 39/04* (2013.01); *F04C 23/008* (2013.01); *F04C 29/026* (2013.01); *F04C 29/028* (2013.01); *F04C 29/12* (2013.01)

(58) Field of Classification Search
CPC .... F04C 18/0215; F04C 29/12; F04C 29/026; F04C 23/008; F04C 29/028
USPC ..... 62/470
See application file for complete search history.

(56) References Cited

U.S. PATENT DOCUMENTS 5,199,271 A * 4/1993 Ewer ..... B64D 13/06 62/157
6,206,648 B1 * 3/2001 Kimura ..... F04B 27/109 184/6.17

(Continued)

FOREIGN PATENT DOCUMENTS

JP 37-2691 5/1962
JP 58-77174 U 5/1983

(Continued)

OTHER PUBLICATIONS

International Preliminary Report of corresponding PCT Application No. PCT/JP2011/051618.
International Search Report of corresponding PCT Application No. PCT/JP2011/051618.

*Primary Examiner* — Frantz Jules
*Assistant Examiner* — Steve Tanenbaum
(74) *Attorney, Agent, or Firm* — Global IP Counselors

(57) ABSTRACT

A compressor includes a casing configured to store lubricating oil in a bottom part, and a compression mechanism accommodated in an interior of the casing. Lubricating oil is separated out from high-pressure refrigerant discharged from the compression mechanism. Lubricating oil separated out by the oil separator flows from a high-pressure space formed in the interior of the casing and into which the high-pressure refrigerant flows. An ejector mechanism is disposed in the interior of the casing, preferably in the high-pressure space. The ejector mechanism includes a refrigerant-accelerating flow path in which the high-pressure refrigerant flows via a narrowed part in order to increase a flow rate of the high-pressure refrigerant, and an oil suction flow path merging with the refrigerant-accelerating flow path.

7 Claims, 13 Drawing Sheets

(51) Int. Cl.

| | |
|---|---|
| ***F04B 39/02*** | (2006.01) |
| ***F04B 39/04*** | (2006.01) |
| ***F04C 23/00*** | (2006.01) |
| ***F04C 29/02*** | (2006.01) |
| ***F04C 29/12*** | (2006.01) |

(56) References Cited

U.S. PATENT DOCUMENTS

2004/0197209 A1* 10/2004 Kitaura ..... F01C 21/10
417/366
2005/0069445 A1 3/2005 Ebara et al.

FOREIGN PATENT DOCUMENTS

| | | | |
|---|---|---|---|
| JP | 1-159492 | A | 6/1989 |
| JP | 5-223074 | A | 8/1993 |
| JP | 3245947 | B2 | 11/2001 |
| JP | 2005-54742 | A | 3/2005 |
| JP | 2005-105985 | A | 4/2005 |
| JP | 2005-240637 | A | 9/2005 |
| JP | 3832369 | B2 | 7/2006 |
| JP | 2009-030612 | A | 2/2009 |

* cited by examiner

COMPRESSOR WITH OIL SEPARATOR AND REFRIGERATION DEVICE INCLUDING THE SAME

TECHNICAL FIELD

The present invention relates to a compressor and to a refrigeration device; more particularly, the present invention relates to a compressor provided with a mechanism for returning, to the compressor, lubricating oil included in refrigerant discharged from the compressor, as well as to a refrigeration device provided with the compressor.

BACKGROUND ART

In general, in a compressor constituting a refrigerant circuit for performing a refrigeration cycle, lubricating oil (refrigerator oil) is used in order to enhance the lubricating performance of a sliding part of a compression mechanism in the interior of the compressor. For this reason, the lubricating oil is included in refrigerant discharged from the compressor. However, when the refrigerant containing the lubricating oil flows into a refrigerant circuit on the exterior of the compressor, a problem emerges in that there is a deficit of lubricating oil in the interior of the compressor and poor lubrication of the sliding part, and in that the lubricating oil sticks to a heat transfer tube in the interior of a condenser and a heat transfer action is inhibited, and others. In view whereof, there has been proposed in the past a configuration for separating out the lubricating oil from the refrigerant compressed in the compressor and for returning the lubricating oil to the compressor, in order to prevent the refrigerant containing the lubricating oil from circulating through the refrigerant circuit.

For example, Patent Literature 1 (Japanese Unexamined Publication No. 5-223074) recites a scroll-type compressor which is connected to an oil separator for separating out lubricating oil from refrigerant discharged from the compressor. A discharge tube installed on an upper surface of a casing of this scroll compressor is in direct communication with the oil separator, which is installed on the exterior of the compressor. Refrigerant discharged from the discharge tube is sent to the interior of the oil separator and passes through oil separating means in which a fine metal wire is formed in a roll, the lubricating oil being thus separated. The lubricating oil separated out from the refrigerant is stored in an oil reservoir chamber in the interior of the oil separator. This oil reservoir chamber communicates with a space at an upper part of the oil reservoir chamber in the interior of the compressor, via an oil return flow path, which has resistance. As such, the lubricating oil stored in the oil reservoir chamber in the interior of the oil separator is returned to the oil reservoir chamber in the interior of the compressor, via the oil return flow path.

SUMMARY OF THE INVENTION

Technical Problem

However, in a conventional scroll compressor, lubricating oil which has been compressed and brought to a high temperature will be returned to a space in the interior of the compressor filled with as-yet uncompressed, low-temperature refrigerant. For this reason, in the conventional scroll compressor, the as-yet uncompressed, low-temperature refrigerant is heated by the high-temperature lubricating oil, and a problem emerges in that compressing the refrigerant, which has been expanded by the heating, leads to a considerable decline in volumetric efficiency.

An objective of the present invention is to provide a compressor whereby any decline in volumetric efficiency can be suppressed in a process for returning, to the interior of the compressor, high-temperature lubricating oil having been separated out by an oil separator.

Solution to Problem

A compressor according to a first aspect of the present invention is provided with a casing, a compression mechanism, an oil separator, and an oil return passage. The casing stores lubricating oil in a bottom part. The compression mechanism is accommodated in the interior of the casing. The oil separator is installed on the exterior of the casing. The oil separator separates out lubricating oil from high-pressure refrigerant discharged from the compression mechanism. The lubricating oil separated out by the oil separator flows through the oil return passage. The oil return passage communicates with a high-pressure space formed in the interior of the casing. The high-pressure refrigerant flows into the high-pressure space.

In the compressor according to the first aspect, the lubricating oil is separated out by the oil separator from the refrigerant compressed by the compression mechanism, and the separated-out lubricating oil is returned directly to the high-pressure space in the interior of the casing by way of the oil return passage. This high-pressure space is a space where refrigerant compressed by the compression mechanism is discharged. As such, in the compressor according to the first aspect, unlike the conventional compressor, the lubricating oil separated out by the oil separator will not be returned to a low-pressure space filled with as-yet uncompressed refrigerant, and therefore the as-yet uncompressed refrigerant will not be heated and expanded by the high-temperature lubricating oil. This makes it possible for any decline in volumetric efficiency to be suppressed in the compressor according to the first aspect.

Further, in the compressor according to the first aspect, there is little difference in pressure between the high-pressure space and the oil return passage, through which the lubricating oil separated out by the oil separator flows. As such, there is no longer a need for a capillary tubing or other pressure adjustment mechanism, which has been necessary in a conventional compression mechanism in order to return only a suitable amount of lubricating oil to the low-pressure space filled with as-yet uncompressed refrigerant. This makes it possible to achieve a cost reduction based on a reduced number of components in the compressor according to the first aspect.

A compressor according to a second aspect of the present invention is the compressor according to the first aspect, further provided with an ejector mechanism formed in the high-pressure space. The ejector mechanism has a refrigerant-accelerating flow path and an oil suction flow path. The high-pressure refrigerant flows in the refrigerant-accelerating flow path via a narrowed part, whereby a flow rate of the high-pressure refrigerant is increased. The oil suction flow path communicates with the oil return passage, the lubricating oil being sucked from the oil return passage into the oil suction flow path. The oil suction flow path merges with the refrigerant-accelerating flow path.

In the compressor according to the second aspect, the flow rate of the refrigerant passing through the narrowed part of the refrigerant-accelerating flow path of the ejector mechanism is increased, and a negative pressure is generated due to an ejector effect in the oil suction flow path merging with the refrigerant-accelerating flow path, wherefore the lubricating oil is sucked in to the oil suction flow path from the oil return passage, and the sucked-in lubricating oil is supplied to the refrigerant-accelerating flow path. This makes it possible to increase the amount of lubricating oil returned to the interior of the compressor in the compressor according to the second aspect.

A compressor according to a third aspect of the present invention is the compressor according to the second aspect, wherein the oil suction flow path merges with the refrigerant-accelerating flow path in a substantially parallel manner.

In the compressor according to the third aspect, because the oil suction flow path merges with the refrigerant-accelerating flow path in a substantially parallel manner, the flow of lubricating oil in the oil suction flow path more readily merges into the refrigerant-accelerating flow path. For this reason, the lubricating oil sucked in to the oil suction flow path from the oil return passage is supplied more efficiently to the refrigerant-accelerating flow path. This makes it possible to further increase the amount of the lubricating oil returned to the interior of the compressor in the compressor according to the third aspect.

A compressor according to a fourth aspect of the present invention is the compressor according to the second aspect or the third aspect, wherein the refrigerant-accelerating flow path is formed from a first flow-path-forming member and a second flow-path-forming member. The first flow-path-forming member, together with the casing, forms a flow path for the high-pressure refrigerant. The second flow-path-forming member, together with the first flow-path-forming member, forms the narrowed part. Further, the oil suction flow path is formed from the casing and the second flow-path-forming member.

In the compressor according to the fourth aspect, the second flow-path-forming member is installed in the interior of a space (hereinbelow called a first space) surrounded by the first flow-path-forming member and the casing, thus forming the refrigerant-accelerating flow path and the oil suction flow path having the narrowed part. The first flow-path-forming member functions as a so-called gas guide member, and the refrigerant compressed by the compression mechanism is able to pass through the first space. The second flow-path-forming member functions as a so-called constricted-flow plate, and is installed such that a part of a flow path for the refrigerant in the first space is gradually narrowed. More specifically, the second flow-path-forming member, together with the first flow-path-forming member, forms a part of the refrigerant-accelerating flow path having the narrowed part. Further, a space (hereinbelow called a second space) is formed between the second flow-path-forming member and the casing. This second space communicates with the first space at a point where the refrigerant has passed through the narrowed part, and is also the oil suction flow path communicating with the oil return passage. This makes it possible to use the first flow-path-forming member and the second flow-path-forming member to efficiently construct the ejector mechanism in the compressor according to the fourth aspect; and, therefore, to achieve a cost reduction based on a reduced number of components.

A compressor according to a fifth aspect of the present invention is the compressor according to the second aspect or the third aspect, further provided with a main frame for supporting the compression mechanism. The main frame has a through-hole. The through-hole communicates with the high-pressure space, and is a space through which the high-pressure refrigerant discharged from the compression mechanism flows. The refrigerant-accelerating flow path includes the through-hole having the narrowed part as well as a space formed from the casing and the main frame. The oil suction flow path includes a space formed from the casing and the main frame.

In the compressor according to the fifth aspect, the narrowed part is formed in the through-hole of the main frame. It is possible to mechanically process the main frame and thereby to provide a narrowed part having a high degree of shape accuracy. This makes it possible to curb any variance in the suction force imparted by the ejector mechanism in the compressor according to the fifth aspect.

A compressor according to a sixth aspect of the present invention is provided with a casing, a compression mechanism, a main frame, and an ejector mechanism. The casing stores lubricating oil in a bottom part. The compression mechanism is accommodated in the interior of the casing. The compression mechanism compresses refrigerant and discharges high-pressure refrigerant. The main frame supports the compression mechanism. The ejector mechanism is accommodated in the interior of the casing. The casing has, in the interior thereof, a high-pressure space and an oil separation space. The high-pressure space is a space into which the high-pressure refrigerant discharged from the compression mechanism flows. The oil separation space is a different space than the high-pressure space, and is a space where lubricating oil is separated out from the high-pressure refrigerant. The main frame has a through-hole and an oil release hole. The through-hole communicates with the high-pressure space, and is a space through which the high-pressure refrigerant discharged from the compression mechanism flows. The oil release hole communicates with the high-pressure space, and is a space where the lubricating oil separated out in the oil separation space flows. The ejector mechanism has a refrigerant-accelerating flow path, where the high-pressure refrigerant flows via a narrowed part whereby the flow rate of the high-pressure refrigerant is increased, and an oil suction flow path, which merges with the refrigerant-accelerating flow path. The refrigerant-accelerating flow path includes a through-hole having a narrowed part as well as a space formed from the casing and the main frame. The oil suction flow path includes an oil release hole.

In the compressor according to the sixth aspect, the lubricating oil separated out in the oil separation space inside the casing will not be stored in the bottom part of the oil separation space, but rather will be rapidly released into the high-pressure space by the ejector mechanism. This makes it possible to curb any decline in the efficiency at which the lubricating oil is separated out in the compressor according to the sixth aspect.

A refrigeration device according to a seventh aspect of the present invention is provided with the compressor according to any of the first through sixth aspects, a condenser, an expansion mechanism, and an evaporator.

In the compressor according to the seventh aspect, a refrigeration device can be provided with the compressor according to any of the first through sixth aspects. This makes it possible to suppress any decline in the coefficient of performance and the refrigeration capacity of the compressor in the refrigeration device according to the seventh aspect.

Advantageous Effects of Invention

The compressor according to the first aspect makes it possible to suppress any decline in volumetric efficiency; and possible to achieve a reduction in cost.

The compressor according to the second aspect makes it possible to increase the amount of the lubricating oil returned to the interior of the compressor.

The compressor according to the third aspect makes it possible to further increase the amount of the lubricating oil returned to the interior of the compressor.

The compressor according to the fourth aspect makes it possible to achieve a reduction in cost.

The compressor according to the fifth aspect makes it possible to curb any variance in the suction force imparted by the ejector mechanism.

The compressor according to the sixth aspect makes it possible to curb any decline in the efficiency at which the lubricating oil is separated out.

The refrigeration device according to the seventh aspect makes it possible to suppress any decline in the coefficient of performance and the refrigeration capacity of the compressor.

DESCRIPTION OF EMBODIMENTS

First Embodiment

A description of the compressor according to the first embodiment of the present invention shall now be provided, with reference to FIGS. 1 to 6. The compressor in the present embodiment is a scroll compressor having two scrolling components in meshed engagement with each other, at least one of which engages in an orbital motion but not in a revolving motion, whereby refrigerant is compressed.

<Configuration>

Figure 1:
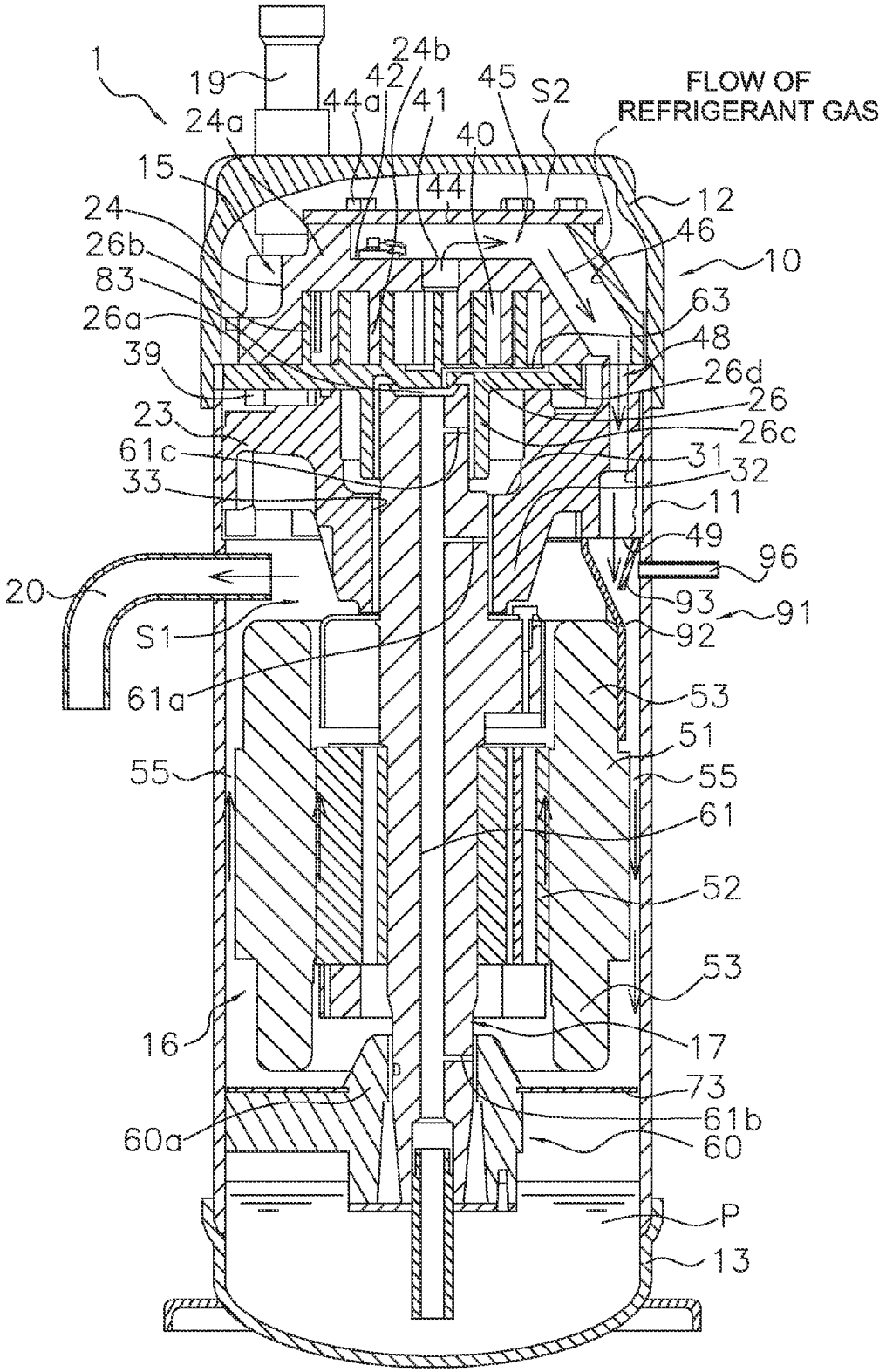
FIG. 1 is a longitudinal cross-sectional view of a scroll compressor according to a first embodiment of the present invention.
Figure 2:
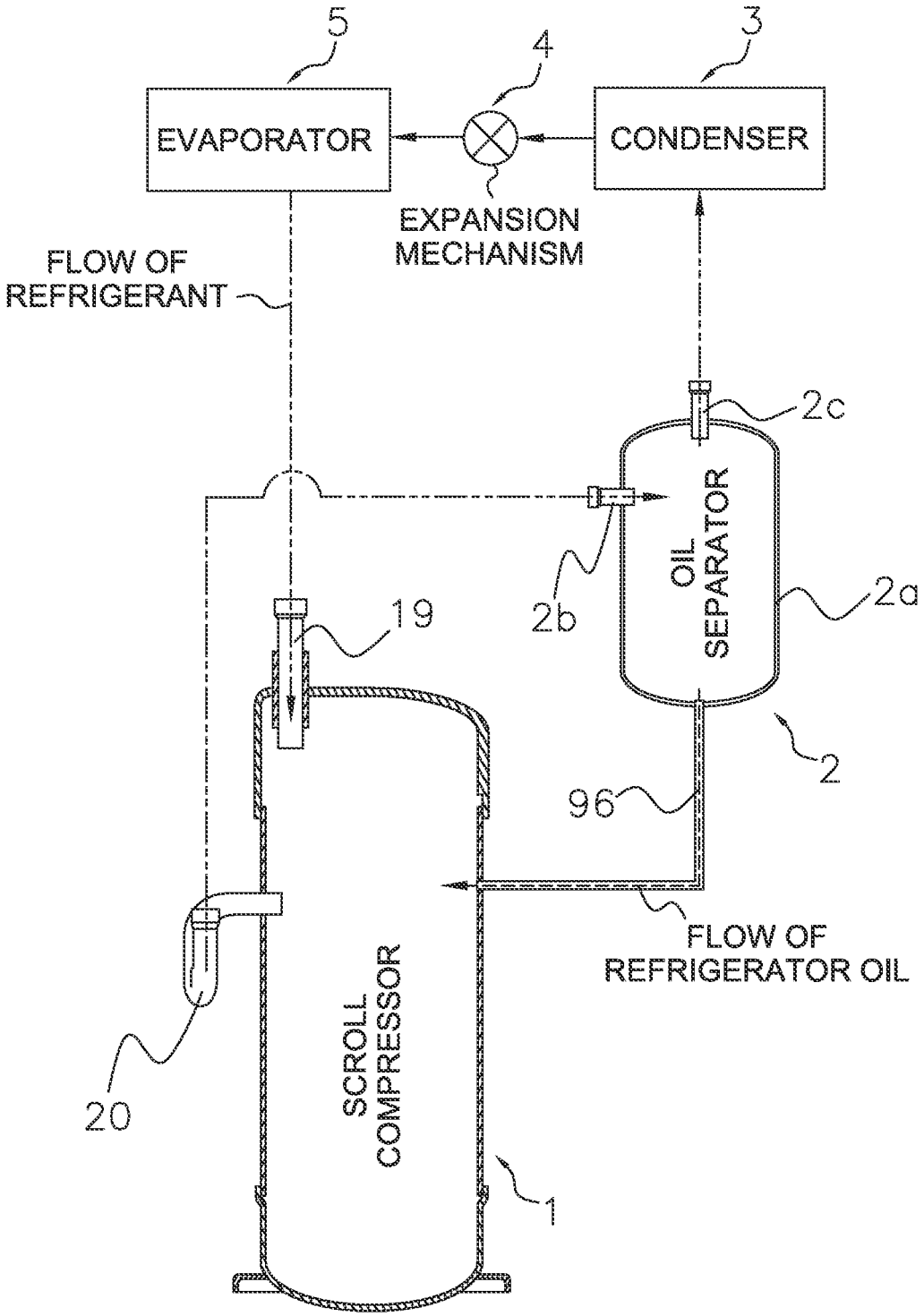
FIG. 2 is a schematic view of a refrigerant circuit to which the scroll compressor according to the first embodiment of the present invention is provided.

FIG. 1 illustrates a longitudinal cross-sectional view of a scroll compressor 1 according to the present embodiment. FIG. 2 illustrates a schematic view of a refrigerant circuit to which the scroll compressor 1 according to the present embodiment as well as an oil separator 2, a condenser 3, an expansion mechanism 4, and an evaporator 5 are provided. The refrigerant circuit moves and operates to perform a refrigeration cycle for circulating refrigerant.

The scroll compressor 1 according to the present embodiment, as illustrated in FIG. 2, is connected via a discharge tube 20 and an oil return passage 96 to the oil separator 2, which is disposed on the exterior of the scroll compressor 1. A more detailed description of the constituent components of the scroll compressor 1 as well as a more detailed description of the oil separator 2 shall be provided below.

(1) Casing

A casing 10 has a substantially cylindrical trunk casing part 11, a bowl-shaped upper wall part 12 hermetically welded to an upper end part of the trunk casing part 11, and a bowl-shaped bottom wall part 13 hermetically welded to a lower end part of the trunk casing part 11. The casing 10 is molded from a rigid member which is less prone to experience deformation or damage in a case where the pressure and temperature change on the interior and/or exterior of the casing 10. The casing 10 is installed such that an axial direction of the substantially cylindrical shape of the trunk casing part 11 runs along the vertical direction. The inside of the casing 10 accommodates: a compression mechanism 15 for compressing refrigerant; a drive motor 16 disposed below the compression mechanism 15; a drive shaft 17 disposed so as to extend in the up-down direction throughout the inside of the casing 10; and the like. An intake tube 19 (described below), the discharge tube 20, and the oil return passage 96 are hermetically joined to the casing 10.

(2) Compression Mechanism

The compression mechanism 15 comprises a fixed scroll component 24 and an orbiting scroll component 26.

The fixed scroll component 24 has a first end plate 24*a*, and a spiral-shaped involute-shaped) first lap 24*b* formed in an upright manner on the first end plate 24*a*. A main suction hole (not shown) and an auxiliary suction hole (not shown) adjacent to the main suction hole are formed on the fixed scroll component 24. The main suction hole creates communication between the intake tube 19 (described below) and a compression chamber 40 (described below), and the auxiliary suction hole creates communication between a low-pressure space S2 (described below) and the compression chamber 40 (described below). A discharge hole 41 is formed on a center part of the first end plate 24*a*, and an expanded recess 42 communicating with the discharge hole 41 is formed on an upper surface of the first end plate 24*a*. The expanded recess 42 comprises a recess expanding in the horizontal direction and disposed in a concave manner on the upper surface of the first end plate 24*a*. A lid body 44 is securely fastened by a bolt 44*a* to the upper surface of the fixed scroll component 24 so as to close off the expanded recess 42. By covering the expanded recess 42, the lid body 44 forms a muffler space 45 composed of an expansion chamber for muting the operating sound of the compression mechanism 15. The fixed scroll component 24 and the lid body 44 are tightly joined interposed by a packing (not shown) and thereby tightly sealed. A first intercommunicating passage 46 communicating with the muffler space 45 and opening on a lower surface of the fixed scroll component 24 is formed on the fixed scroll component 24.

The orbiting scroll component 26 comprises a second end plate 26*a* and a spiral-shaped (involute-shaped) second lap 26*b* formed in an upright manner on the second end plate 26*a*. A second bearing part 26*c* is formed on a lower surface center part of the second end plate 26*a*. An oil supply hole 63 is formed on the second end plate 26*a*. The oil supply hole 63 communicates between an upper surface outer peripheral part of the second end plate 26*a* and a space on the inside of the second bearing part 26*c*. The first lap 24*b* and the second lap 26*b* mesh together, whereby the fixed scroll component 24 and the orbiting scroll component 26 form the compression chamber 40 enclosed by the first end plate 24*a*, the first lap 24*b*, the second end plate 26*a*, and the second lap 26*b*.

(3) Main Frame

The main frame 23 is installed below the compression mechanism 15 and is hermetically joined to an inner wall of the casing 10 at an outer peripheral surface thereof. For this reason, the interior of the casing 10 is subdivided into a high-pressure space S1 below the main frame 23, and the low-pressure space S2 above the main frame 23. The main frame 23 has a main frame recess 31 disposed in a concave manner on an upper surface of the main frame 23, and a first bearing part 32 extending downward from a lower surface of the main frame 23. A first bearing hole 33 penetrating in the up-down direction is formed in the first bearing part 32. The fixed scroll component 24 is bolted or otherwise securely situated on the main frame 23, and the orbiting scroll component 26 is clamped together with the fixed scroll component 24 interposed by an Oldham coupling 39 (described below). A second intercommunicating passage 48 penetrating in the up-down direction is formed on an outer peripheral part of the main frame 23. The second intercommunicating passage 48 communicates with the first intercommunicating passage 46 on the upper surface of the main frame 23, and communicates with the high-pressure space S1 via a discharge port 49 on the lower surface of the main frame 23.

(4) Oldham Coupling

The Oldham coupling 39 is a ring-shaped member for preventing the orbiting scroll component 26 from engaging in revolving motion, and is fitted into an oblong-shaped Oldham groove 26*d* formed on the main frame 23.

(5) Drive Motor

The drive motor 16 is a brushless DC motor installed below the main frame 23. The drive motor 16 comprises a stator 51 fixed to the inner wall of the casing 10, and a rotor 52 provided with a slight clearance and accommodated so as to be able to rotate on the inside of the stator 51.

A copper wire is wound around teeth of the stator 51 and a coil end 53 is formed thereabove and therebelow. An outer peripheral surface of the stator 51 is provided with a core-cut part formed over a lower end surface from an upper end surface of the stator 51 so as to be notched at a plurality of points, placed at predetermined intervals in the circumferential direction. The core-cut part forms a motor cooling passage 55 extending in the up-down direction between the trunk casing part 11 and the stator 51.

The rotor 52 is coupled to the orbiting scroll component 26 via a drive shaft 17 (described below) in a center of rotation thereof.

(6) Secondary Frame

A secondary frame 60 is disposed below the drive motor 16. The secondary frame 60 is fixed to the trunk casing part 11 and has a third bearing part 60*a*.

(7) Oil Separation Plate

An oil separation plate 73 is a plate-shaped member installed below the drive motor 16 within the casing 10, and fixed to an upper surface side of the secondary frame 60. The oil separation plate 73 separates the lubricating oil included in the descending compressed refrigerant. The lubricating oil separated out falls to an oil reservoir P at a bottom part of the casing 10.

(8) Drive Shaft

The drive shaft 17 is coupled to the compression mechanism 15 and to the drive motor 16, and is disposed so as to extend in the up-down direction throughout the inside of the casing 10. A lower end part of the drive shaft 17 is positioned at the oil reservoir P. An oil supply path 61 penetrating in an axial direction is formed in the interior of the drive shaft 17. The oil supply path 61 communicates with an oil chamber 83 formed of an upper end surface of the drive shaft 17 and a lower surface of the second end plate 26*a*. The oil chamber 83 communicates with a sliding part of the fixed scroll component 24 and the orbiting scroll component 26 (hereinafter simply called the "sliding part of the compression mechanism 15"), via the oil supply hole 63 of the second end plate 26*a*, and ultimately leads to the low-pressure space S2. As such, when the drive shaft 17 engages in an axial rotational motion, a centrifugal pump action and a high-low pressure difference cause the lubricating oil being stored in the oil reservoir P to flow upward through the oil supply path 61 and to be supplied to the oil chamber 83. Thereafter, the lubricating oil passes by way of the oil supply hole 63 and lubricates the sliding part of the compression mechanism 15.

The drive shaft 17 has on the interior thereof a first horizontal oil supply hole 61*a*, a second horizontal oil supply hole 61*b*, and a third horizontal oil supply hole 61*c*, for supplying lubricating oil to the first bearing part 32, the third bearing part 60*a*, and the second bearing part 26*c*, respectively. The lubricating oil ascending through the oil supply path 61 is supplied to the first horizontal oil supply hole 61*a*, the second horizontal oil supply hole 61*b*, and the third horizontal oil supply hole 61*c*, and lubricates a sliding bearing part of the drive shaft 17.

(9) Ejector Mechanism

Figure 3:
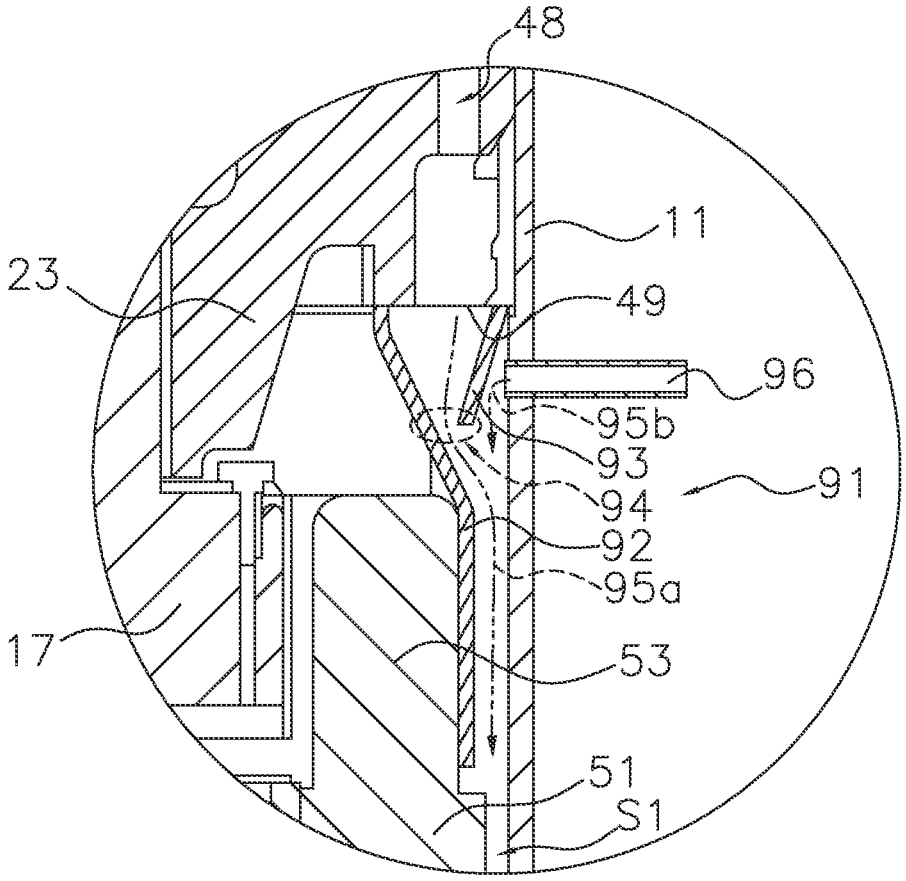
FIG. 3 is a detailed longitudinal cross-sectional view of the vicinity of an ejector mechanism of the scroll compressor according to the first embodiment of the present invention.
Figure 4A:
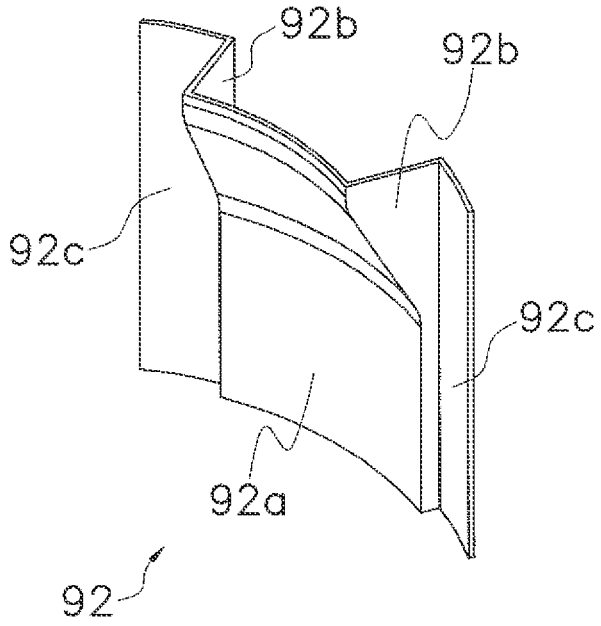
FIG. 4 is a perspective view of a gas guide constituting the ejector mechanism according to the first embodiment of the present invention.
Figure 4B:
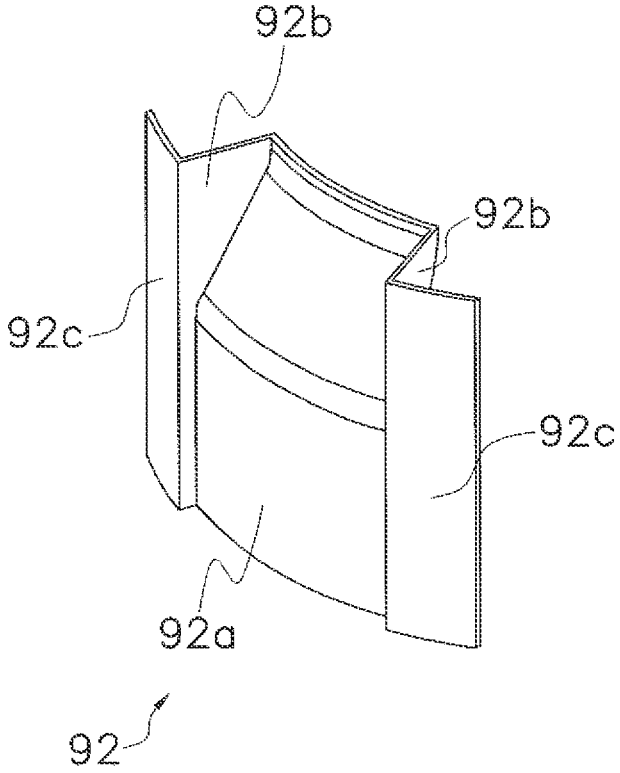
Figure 5A:
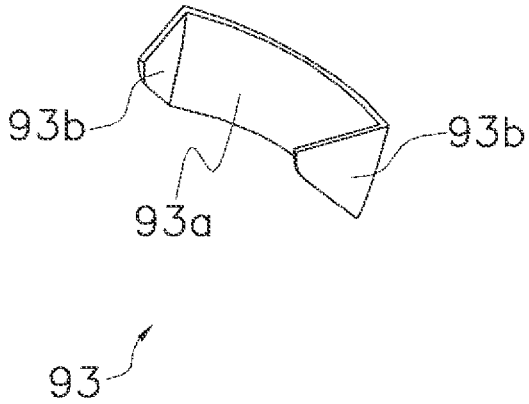
FIG. 5 is a perspective view of a constricted-flow plate for constituting the ejector mechanism according to the first embodiment of the present invention.
Figure 5B:
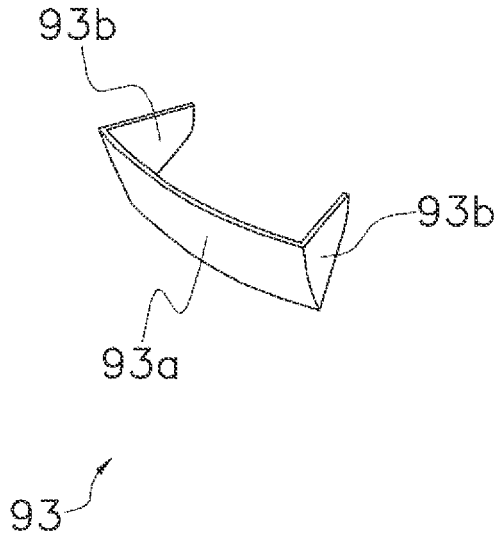
Figure 6:
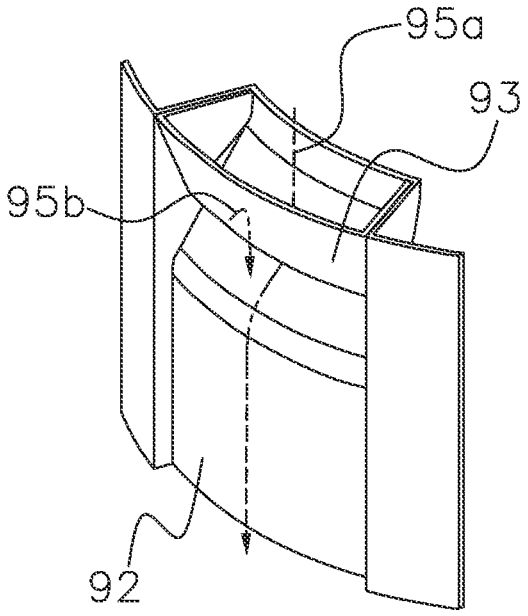
FIG. 6 is a perspective view of the gas guide in combination with the constricted-flow plate according to the first embodiment of the present invention.

An ejector mechanism 91 is positioned below the discharge port 49 opening on the lower surface of the main frame 23. The ejector mechanism 91 comprises a gas guide 92 and a constricted-flow plate 93. FIG. 3 provides a more detailed illustration of the ejector mechanism 91 set forth in FIG. 1, FIGS. 4 and 5 illustrate perspective views of the gas guide 92 and the constricted-flow plate 93, respectively, constituting the ejector mechanism 91. FIG. 6 illustrates a perspective view of the gas guide 92 in combination with the constricted-flow plate 93.

The gas guide 92, as is illustrated in FIG. 4, comprises a first flow path-forming part 92*a*, two first side wall parts 92*b*, and two outer wall parts 92*c*, Each of the two first side wall parts 92*b* is provided extending from both end parts of the first flow path-forming part 92*a*, and each of the two outer wall parts 92*c* is provided extending from both end parts of each of the first side wall parts 92*b*. The outer wall parts 92*c* have a surface which matches the shape of the inner wall of the casing 10, and the gas guide 92 can be tightly joined in a complete manner to the inner wall surface of the casing 10 at the outer wall parts 92*c*. For this reason, in a case where the gas guide 92 has been tightly joined to the inner wall surface of the casing 10, then the first flow path-forming part 92*a* and the first side wall parts 92*b*, together with the inner wall of the casing 10, form a space which opens at an upper end and a lower end. The upper end of the gas guide 92, as is illustrated in FIG. 3, is in contact with the lower surface of the main frame 23, and therefore the space formed between the gas guide 92 and the casing 10 serves as a flow path for refrigerant, the flow path communicating from the second intercommunicating passage 48 via the discharge port 49. The shape of the gas guide 92 as illustrated in FIG. 3 represents the shape of the longitudinal cross-section of the first flow path-forming part 92*a*.

The constricted-flow plate 93, as is illustrated in FIG. 5, comprises a second flow path-forming part 93*a* and two second side wall parts 93*b*. The two second side wall parts 93*b* are provided each extending from both end parts of the second flow path-forming part 93*a*, Each of the second side wall parts 93*b* can be tightly joined to each of the first side wall parts 92*b* of the gas guide 92, whereby the constricted-flow plate 93 can be combined with the gas guide 92, as illustrated in FIG. 6. The shape of the constricted-flow plate 93 illustrated in FIG. 3 represents the shape of the longitudinal cross-section of the second flow path-forming part 93*a*. Specifically, the second flow path-forming part 93*a* is positioned between the casing 10 and the first flow path-forming part 92*a* of the gas guide 92.

As is illustrated in FIG. 3, the gap between the first flow path-forming part 92*a* of the gas guide 92 and the second flow path-forming part 93*a* of the constricted-flow plate 93 gradually narrows as the gap advances downward from above. Herein, a narrowed part 94 is formed where the gap between the first flow path-forming part 92*a* and the second flow path-forming part 93*a* reaches a minimum. The refrigerant having flowed in from the second flow path-forming part 48 increases in flow rate upon passing through the narrowed part 94, and therefore a space formed by the gas guide 92, the constricted-flow plate 93, and the casing 10 forms a refrigerant-accelerating flow path 95*a*.

The space between the constricted-flow plate 93 and the casing 10 forms a part of an oil suction flow path 95*b* communicating with the oil return passage 96. The oil suction flow path 95*b* merges with the refrigerant-accelerating flow path 95*a* at an intercommunicating space 48*b*. An upper end part of the constricted-flow plate 93 is in contact with the casing 10, and therefore the refrigerant flowing through the refrigerant-accelerating flow path 95*a* merges with the oil suction flow path 95*b* at a point where the refrigerant has passed through the narrowed part 94.

(10) Oil Separator

The oil separator 2 has a function for separating the lubricating oil from the refrigerant and returning the separated lubricating oil to the high-pressure space S1 within the casing 10 via the oil return passage 96, so as to prevent the compressed refrigerant discharged from the discharge tube 20 of the scroll compressor 1 from flowing into the exterior refrigerant circuit in a state where the compressed refrigerant includes lubricating oil.

The oil separator 2, as is illustrated in 2, has a tank 2*a* internally provided with a mechanism for separating out the lubricating oil from the refrigerant; an inlet tube 2*b* for introducing the refrigerant containing the lubricating oil, into the interior of the tank 2*a* from the discharge tube 20 of the scroll compressor 1; an outlet tube 2*c* for supplying, from the tank 2*a* to the exterior refrigerant circuit, the refrigerant from which the lubricating oil has been separated out; and the oil return passage 96, serving as a flow path for returning, to the high-pressure space S1 within the casing 10, the lubricating oil having been separated out from the refrigerant. The oil return passage 96 is joined to a bottom part of the tank 2*a*.

(11) Intake Tube

The intake tube 19 is a member for guiding the refrigerant to the compression mechanism 15, and is hermetically fitted into the upper wall part 12 of the casing 10.

(12) Discharge Tube

The discharge tube 20 is a member for discharging the refrigerant from the casing 10, and is hermetically fitted to a position in the high-pressure space S1 in the trunk casing part 11 of the casing 10.

(13) Oil Return Passage

The oil return passage 96 is a tube for returning, to the high-pressure space S1 in the trunk casing part 11 of the casing 10, the lubricating oil separated out by the oil separator 2 from the refrigerant compressed by the compression mechanism 15. As is illustrated in FIG. 3, the oil return passage 96 is joined to the casing 10 at a position above the lower end of the constricted-flow plate 93.

<Operation>

A description of the motion and operation of the scroll compressor 1 of the present embodiment shall now be provided. The description shall first relate to the flow of the refrigerant; thereafter, the process by which the lubricating oil is returned to the high-pressure space S1 of the scroll compressor 1 from the oil separator 2 by way of the oil return passage 96 shall be described.

The description shall first relate to the flow of the refrigerant. Firstly, when the drive motor 16 is started up, the drive shaft 17 begins to engage in an axial rotational motion in association with the rotation of the rotor 52. The axial rotational force of the drive shaft 17 is transmitted to the orbiting scroll component 26 via the second bearing part 26*c*. The orbiting scroll component 26 is prohibited from engaging in revolving motion by the Oldham coupling 39, and therefore engages in orbital motion, but not revolving motion, about a center of axial rotation of the drive shaft 17. The refrigerant is supplied to the compression chamber 40 of the compression mechanism 15 from the intake tube 19 by way of the main suction hole, or from the low-pressure space S2 by way of the auxiliary suction hole. The orbiting motion of the orbiting scroll component 26 causes the compression chamber 40 to move from the outer peripheral part of the fixed scroll component 24 toward the center part, while also causing the volume to gradually be reduced. As a result thereof, the refrigerant inside the compression chamber 40 is compressed and discharged from the discharge hole 41 to the muffler space 45. The compressed refrigerant flows from the discharge port 49 into the high-pressure space S1 by way of the first intercommunicating passage 46 and the second intercommunicating passage 48, and passes through the ejector mechanism 91 to ultimately be discharged from the discharge tube 20. The high-pressure refrigerant discharged from the scroll compressor 1 is supplied to the exterior refrigerant circuit after the lubricating oil has been separated out therefrom in the oil separator 2, and is introduced into the intake tube 19 of the scroll compressor 1 by way of the condenser 3, the expansion mechanism 4, and the evaporator 5.

During this compression operation of the refrigeration cycle, the lubricating oil stored in the oil reservoir P ascends through the oil supply path 61 of the drive shaft 17, due to the centrifugal pump action and the high-low pressure difference, and is supplied to the sliding part of the compression mechanism 15 by way of the oil chamber 83 and the oil supply hole 63. Because the sliding part is in contact with the compression chamber 40, the lubricating oil supplied to the sliding part of the compression mechanism 15 is supplied to the compression chamber 40. As a result thereof, the lubricating oil supplied to the compression chamber 40 is compressed together with the refrigerant. The lubricating oil, having lubricated the sliding part in the first bearing part 32 and the second bearing part 26, leaks out to the high-pressure space S1 from the lower end of the first bearing part 32, and is supplied to the high-pressure space S1 via an oil passage (not shown) which is formed in the main frame 23 and communicates with the main frame recess 31 and the high-pressure space S1. As such, the high-pressure refrigerant discharged from the scroll compressor 1 contains lubricating oil.

The high-pressure refrigerant containing the lubricating oil discharged from the scroll compressor 1 is taken into the interior of the tank 2*a* from the inlet tube 2*b* of the oil separator 2, and the lubricating oil is separated out. Centrifugation is an example of a scheme for separating out the lubricating oil from the refrigerant. With centrifugation, an orbiting plate is disposed in the interior of the tank 2*a*, and the refrigerant is made to perform an orbiting motion; the centrifugal force causes droplets of the lubricating oil included in the refrigerant to be separated out. The lubricating oil separated out from the refrigerant is stored in the bottom part of the tank 2*a*, and the refrigerant from which the lubricating oil has been separated out is supplied from the outlet tube 2*c* to the exterior refrigerant circuit. The lubricating oil stored in the bottom part of the tank 2*a* is returned to the high-pressure space S1 in the interior of the scroll compressor 1, via the oil return passage 96. A description of the process therefor shall now be provided.

The refrigerant compressed by the compression mechanism 15 passes through the ejector mechanism 91 and is ultimately discharged from the discharge tube 20. The refrigerant, when passing through the ejector mechanism 91, flows through the refrigerant-accelerating flow path 95*a*. At such a time, because the flow path of the refrigerant is tightened in the narrowed part 94, the flow rate of the refrigerant is increased. Because the refrigerant in the refrigerant-accelerating flow path 95*a* merges with the oil suction flow path 95*b* at a point where the refrigerant has passed through the narrowed part 94, a negative pressure is generated in the oil suction flow path 95*b* due to an ejector effect. The lubricating oil inside the oil return passage 96, which communicates with the oil suction flow path 95*b*, is thereby sucked into the oil suction flow path 95*b*. The lubricating oil sucked into the oil suction flow path 95*b* merges into the flow of refrigerant in the refrigerant-accelerating flow path 95*a*, falls through the high-pressure space S1, and is supplied to the oil reservoir P in the bottom part of the casing 10.

<Features>

In the scroll compressor 1 according to the present embodiment, the ejector effect generated when the refrigerant compressed by the compression mechanism 15 passes through the ejector mechanism 91 disposed in the high-pressure space S1 inside the casing 10 causes the lubricating oil separated out by the oil separator 2 to be sucked into the high-pressure space S1 from the oil return passage 96. This makes it possible to prevent the as-yet uncompressed refrigerant from being heated and expanded by the high-temperature lubricating oil, because, in the scroll compressor 1 according to the present embodiment, the high-temperature lubricating oil separated out by the oil separator is not returned to a space filled with the as-yet uncompressed refrigerant (for example, a suction tube for the refrigerant of the compressor). As such, the scroll compressor 1 according to the present embodiment makes it possible to suppress any decline in volumetric efficiency of the compressor.

Further, in the scroll compressor 1 according to the present embodiment, there is no longer a need for a capillary tubing or other pressure adjustment mechanism, which has been necessary in a conventional compressor in order to return only a suitable amount of lubricating oil to the low-pressure space filled with as-yet uncompressed refrigerant. As such, the scroll compressor 1 according to the present embodiment makes it possible to achieve a reduction in costs by reducing the number of components in the compressor.

Also, in the scroll compressor 1 according to the present embodiment, the ejector mechanism 91, which has no moving parts, is used in order to realize a mechanism whereby lubricating oil is sucked into the high-pressure space S1 from the oil return passage 96. As such, the scroll compressor 1 according to the present embodiment has an oil return mechanism which is simple to set up and maintain.

Modification Examples

In the present embodiment, the scroll compressor 1 provided with the compression mechanism 15, constituted of the fixed scroll component 24 and the orbiting scroll component 26, is used as the compressor, but a compressor provided with a different compression mechanism may also be used. For example, a rotary-type compressor and/or a screw-type compressor may be used.

Further, in the present embodiment, the oil separator 2 is disposed on the exterior of the casing 10 of the scroll compressor 1, but an oil separation mechanism equivalent to the oil separator 2 may also be disposed on the interior of the casing 10. This makes it possible to render the refrigerant circuit more compact.

Second Embodiment

A description of a compressor according to a second embodiment of the present invention shall now be provided, with reference to FIGS. 7 to 10. A scroll compressor 101 according to the present embodiment has identical configurations, operations, and features in common with the scroll compressor 1 according to the first embodiment. Hereinbelow, the description shall focus on the points of disparity between the scroll compressor 101 according to the present embodiment and the scroll compressor 1 according to the first embodiment.

<Configuration>

Figure 7:
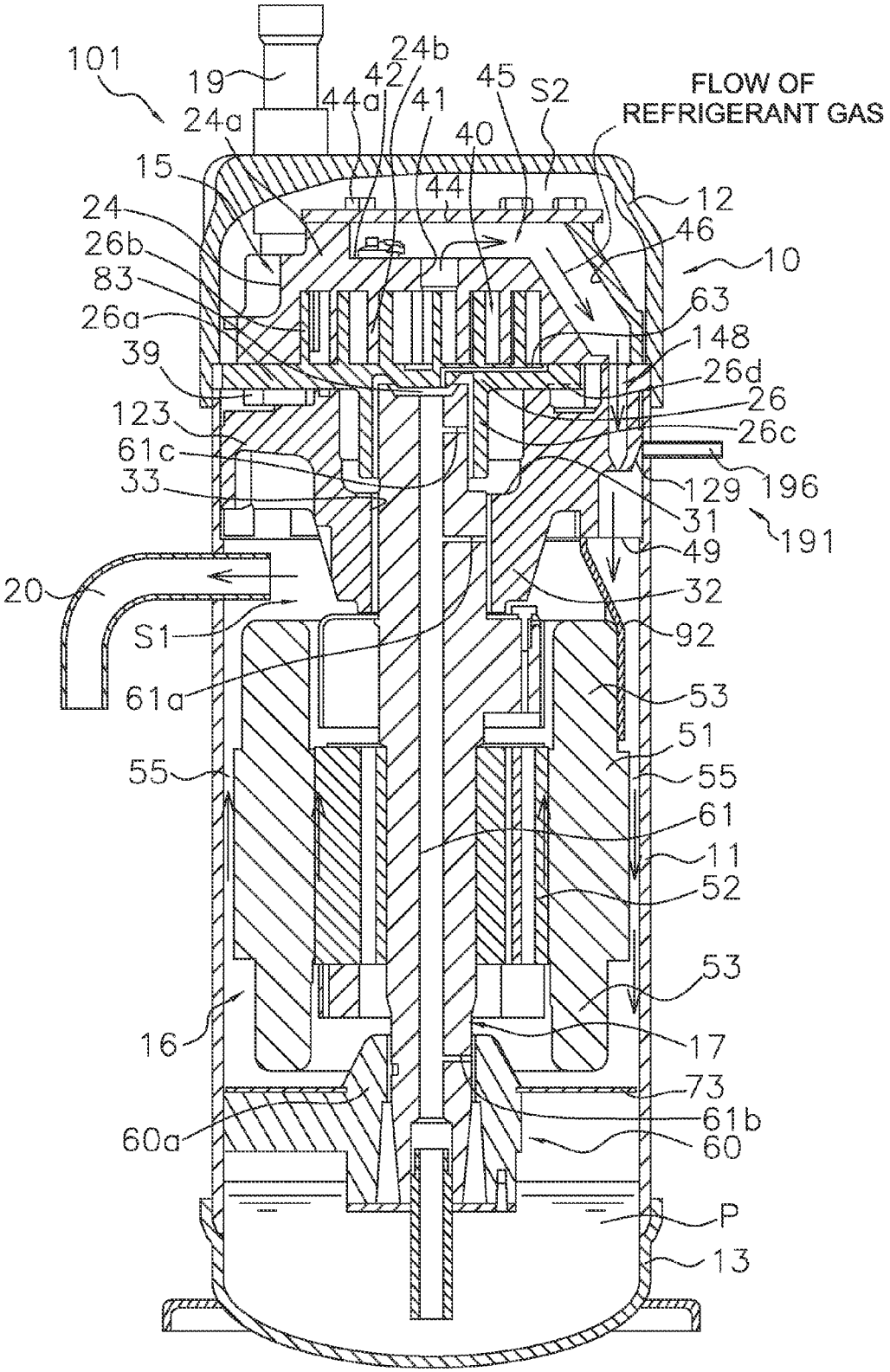
FIG. 7 is a longitudinal cross-sectional view of a scroll compressor according to a second embodiment of the present invention.
Figure 8:
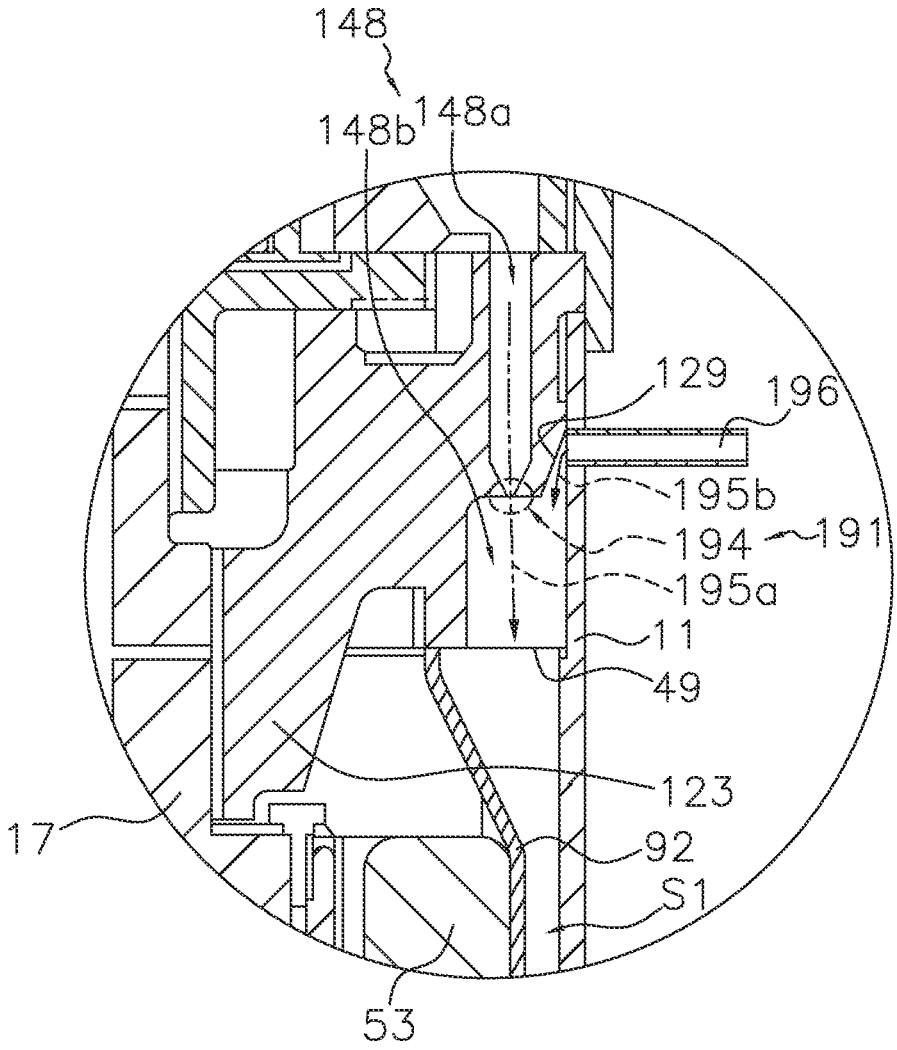
FIG. 8 is a detailed longitudinal cross-sectional view of the vicinity of an ejector mechanism of the scroll compressor according to the second embodiment of the present invention.
Figure 9:
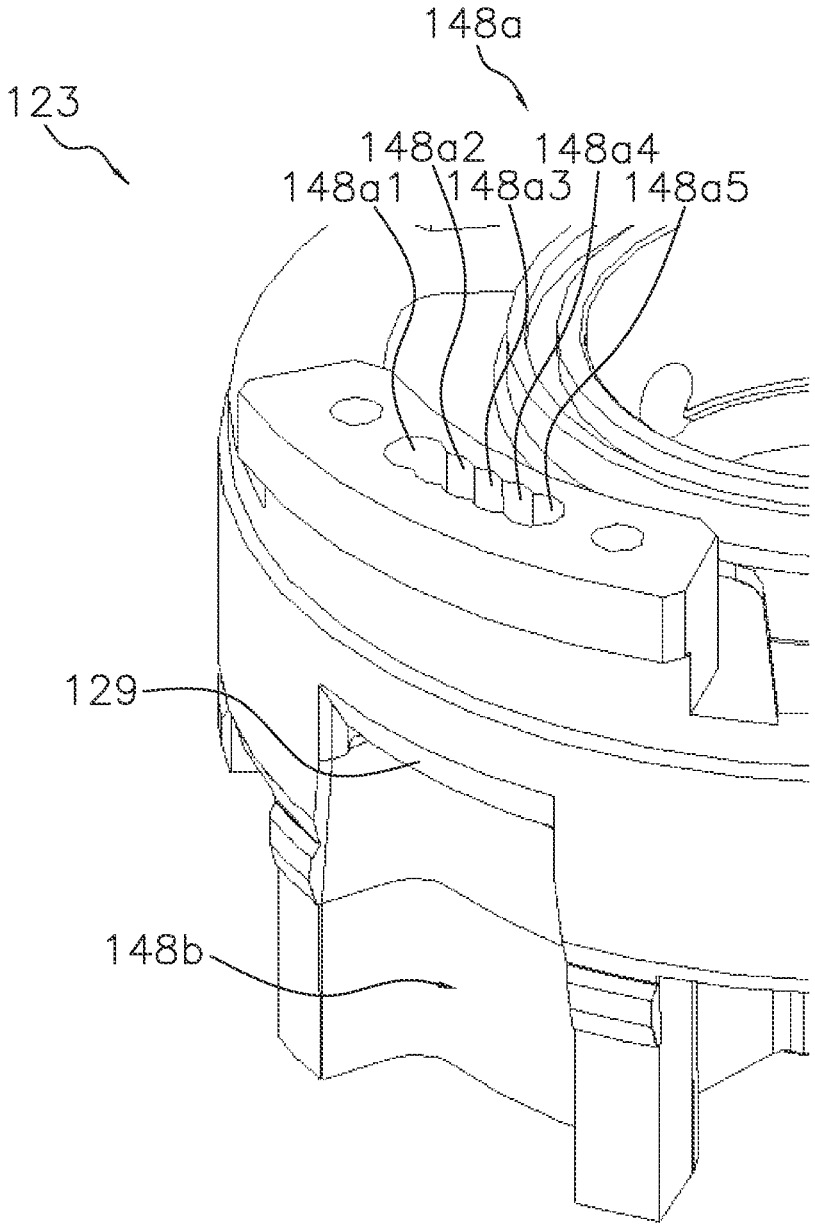
FIG. 9 is an external view of a main frame according to the second embodiment of the present invention.
Figure 10:
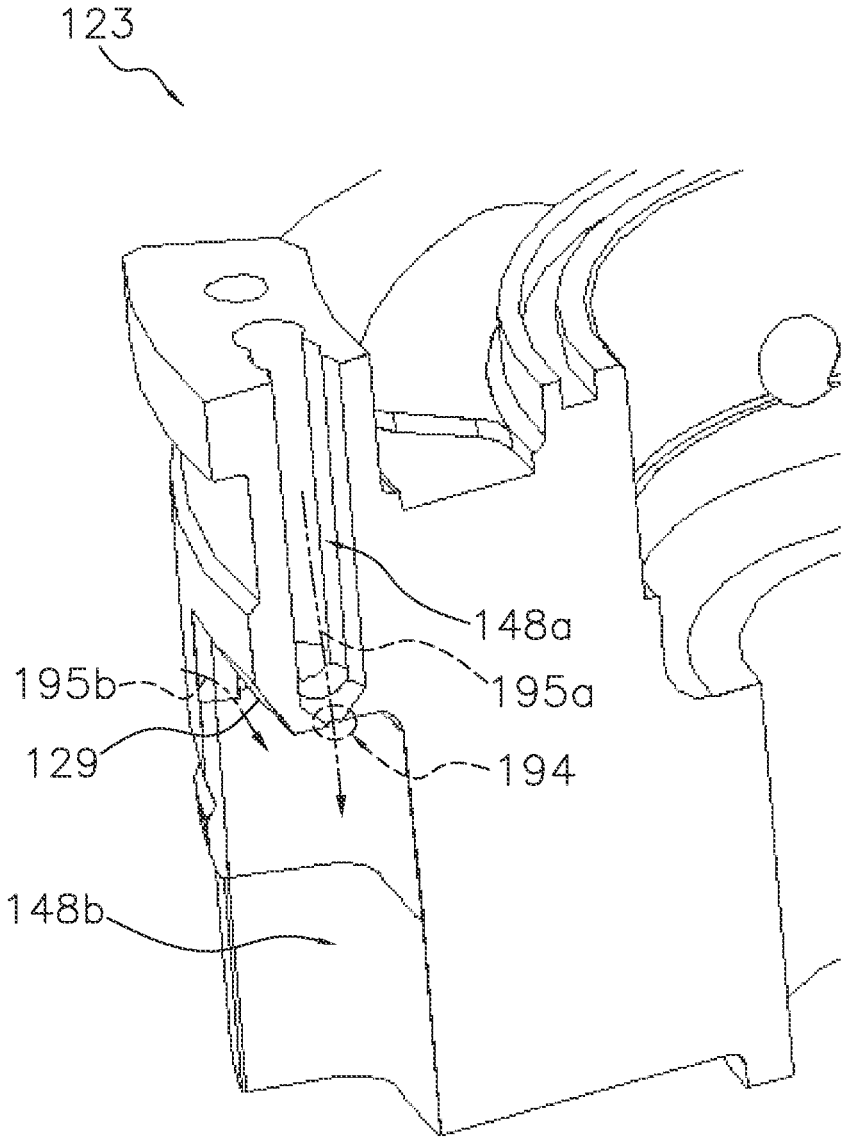
FIG. 10 is a cross-sectional view of the main frame according to the second embodiment of the present invention.

FIG. 7 illustrates a longitudinal cross-sectional view of the scroll compressor 101 according to the present embodiment. FIG. 8 illustrates an enlarged cross-sectional view of the vicinity of an ejector mechanism 191 used in the present embodiment. FIGS. 9 and 10 illustrate an external view and a cross-sectional view, respectively of a main frame 123 used in the present embodiment. In FIGS. 7 to 10, constituent elements identical to those of the scroll compressor 1 according to the first embodiment have been assigned reference numerals identical to those in FIG. 1.

(1) Main Frame

In the present embodiment, as is illustrated in FIG. 7, the main frame 123 has a second intercommunicating passage 148. Similarly with respect to the second intercommunicating passage 48 in the first embodiment, the second intercommunicating passage 148 communicates with the first intercommunicating passage 46 on an upper surface of the main frame 123, and communicates with the high-pressure space S1 via the discharge port 49 on a lower surface of the main frame 123. As is illustrated in FIG. 8, the second intercommunicating passage 148 comprises a frame through-hole 148*a* penetrating through the main frame 123 in the vertical direction, and an intercommunicating space 148*b* positioned below the frame through-hole 148*a* and formed between an outer peripheral surface of the main frame 123 and the inner wall surface of the trunk casing part 11. As is illustrated in FIGS. 9 and 10, the frame through-hole 148*a* has a plurality of interlinking through-holes 148*a*1, 148*a*2, . . . formed along a circumferential direction of the main frame 123. As is illustrated in FIGS. 8 and 10, a lower end part of each of the through-holes 148*a*1, 148*a*2, . . . has a truncated cone shape oriented vertically downward. More specifically, the horizontal surface area of the lower end parts of each of the through-holes 148*a*1, 148*a*2, . . . gradually becomes smaller proceeding downward from above in the vertical direction.

In the present embodiment, the main frame 123 has a tapered part 129. As is illustrated in FIG. 8 to 10, the tapered part 129 is a surface which is formed in the intercommunicating space 148*b* and is tilted inward in the radial direction from the outside in the radial direction of the trunk casing part 11 as the surface proceeds downward from above in the vertical direction.

(2) Ejector Mechanism

A description of the constituent elements of the ejector mechanism 191 in the present embodiment shall now be provided. As is illustrated in FIG. 8, the tapered part 129 forms a part of an oil suction flow path 195*b* with the inner wall surface of the trunk casing part ill. The oil suction flow path 195*b* merges with a refrigerant-accelerating flow path 195*a* in the intercommunicating space 148*b*. An oil return passage 196 communicates with the oil suction flow path 195*b*. An upper end of the oil return passage 196 is positioned on an upper end of the tapered part 129. The frame through-hole 148*a* and the intercommunicating space 148*b* constitute the refrigerant-accelerating flow path 195*a*. A lower end of the frame through-hole 148*a* is a narrowed part 194 where a flow path cross-sectional area of the refrigerant-accelerating flow path 195*a* reaches a minimum.

<Action>

A description of a process in the present embodiment by which the lubricating oil separated out by the oil separator 2 is returned to the high-pressure space S1 by the ejector mechanism 191 via the oil return passage 196 shall now be provided. The refrigerant compressed by the compression mechanism 15, when flowing through the refrigerant-accelerating flow path 195*a*, passes through the narrowed part 194. At such a time, the flow path of the refrigerant is tightened, whereby the flow rate of the refrigerant is increased. A negative pressure is generated, due to the ejector effect, in the oil suction flow path 195*b* merging with the refrigerant-accelerating flow path 195*a*. The lubricating oil within the oil return passage 196 is thereby sucked into the oil suction flow path 195*b*. The lubricating oil sucked into the oil suction flow path 195*b* flows into the refrigerant-accelerating flow path 195*a*, thereafter falls through the high-pressure space S1, and is supplied to the oil reservoir P of the bottom part of the casing 10.

<Features>

In the scroll compressor 101 according to the present embodiment, the main frame 123 has the frame through-hole 148*a* and the narrowed part 194. The high-pressure refrigerant compressed by the compression mechanism 15 flows into the frame through-hole 148*a*. The frame through-hole 148*a* communicates with the high-pressure space S1. The refrigerant-accelerating flow path 195*a* comprises the frame through-hole 148*a* and the intercommunicating space 148*b* firmed from the trunk casing part 11 and the main frame 123. The oil suction flow path 195*b* is formed from the tapered part 129 of the main frame 123 and the trunk casing part 11.

In the present embodiment, it is possible to mechanically process the main frame 123 to form the frame through-hole 148*a* having the narrowed part 194. This makes it possible to increase the shape accuracy of the narrowed part 194. As such, in the present embodiment, it possible to curb any variance in the suction force imparted by the ejector mechanism 191.

Further, in the scroll compressor 1 according to the first embodiment, a concern is presented in that the refrigerant yet to pass through the narrowed part 94 may leak out from a gap between the gas guide 92 and the main frame 23. However, in the scroll compressor 101 according to the present embodiment, the refrigerant compressed by the compression mechanism 15, when flowing through the refrigerant-accelerating flow path 195*a*, will reliably pass through the narrowed part 194; therefore, no concern is presented that the refrigerant having not yet passed through the narrowed part 194 will leak out.

Also, in the scroll compressor 101 according to the present embodiment, there is no need to install the constricted-flow plate 93 used in the scroll compressor 1 according to the first embodiment.

(Modifications)

In the scroll compressor 101 according to the present embodiment, each of the through-holes 148*a*1, 148*a*2, . . . constituting the frame through-hole 148*a* has, at the lower end part, a truncated cone shape oriented downward in the vertical direction, but it is possible for at least one through-hole from among the through-holes 148*a*1, 148*a*2, . . . to have, at the lower end part, a truncated cone shape oriented downward in the vertical direction. In the present modification example as well, the frame through-hole 148*a* has the narrowed part 194.

Third Embodiment

Figure 11:
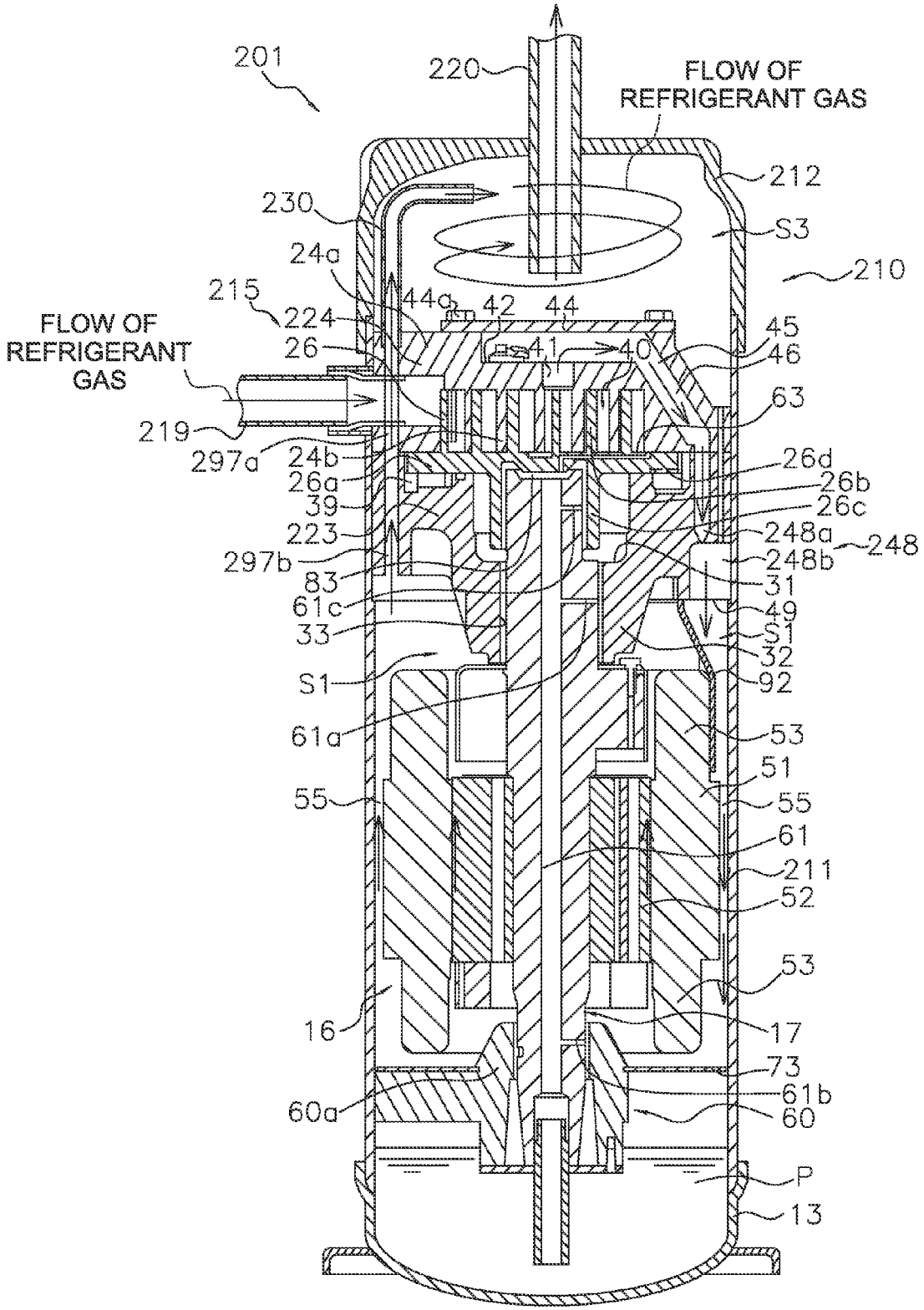
FIG. 11 is a longitudinal cross-sectional view of a scroll compressor according to a third embodiment of the present invention.
Figure 12:
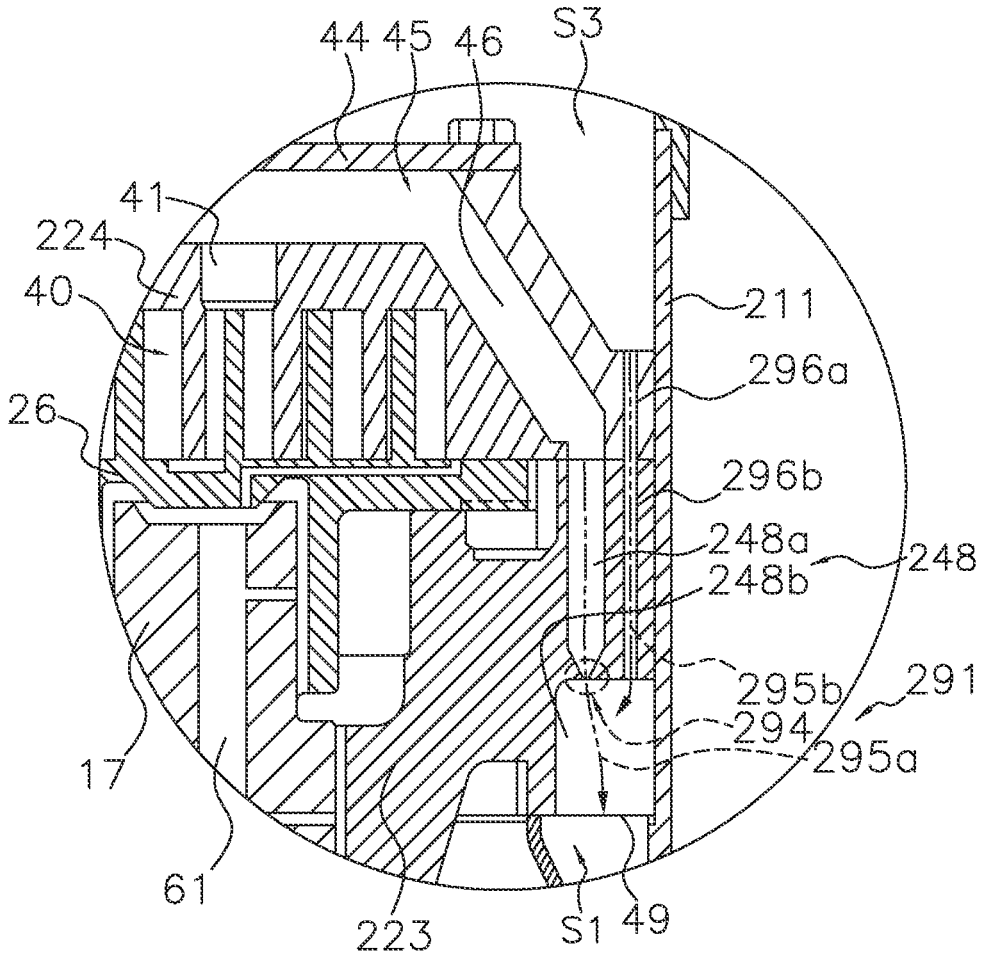
FIG. 12 is a detailed longitudinal cross-sectional view of the vicinity of an ejector mechanism of the scroll compressor according to the third embodiment of the present invention.
Figure 13:
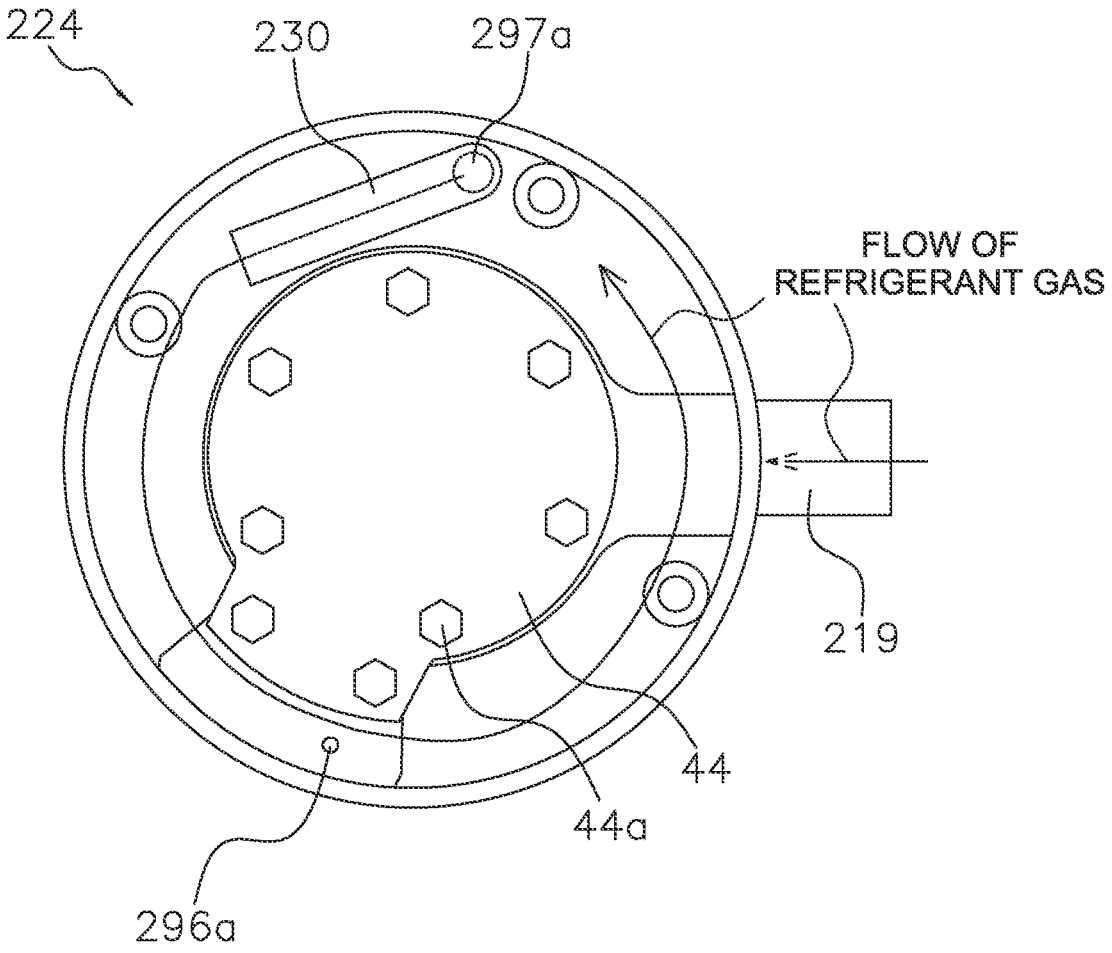
FIG. 13 is a top view of a fixed scroll component of the scroll compressor according to the third embodiment of the present invention.

A description of a compressor according to a third embodiment of the present invention shall now be provided, with reference to FIGS. 11 to 13. A scroll compressor 201 according to the present embodiment has identical configurations, operations, and features in common with the scroll compressor 101 according to the second embodiment. Hereinbelow, the description shall focus on the points of disparity between the scroll compressor 201 according to the present embodiment and the scroll compressor 101 according to the second embodiment.

<Configuration>

FIG. 11 illustrates a longitudinal cross-sectional view of the scroll compressor 201 according to the present embodiment. FIG. 12 illustrates an enlarged cross-sectional view of the vicinity of an ejector mechanism 291 used in the present embodiment. FIG. 13 illustrates a top view of a fixed scroll component 224 used in the present embodiment. In FIGS. 11 to 13, constituent elements identical to those of the scroll compressor 101 according to the second embodiment have been assigned reference numerals identical to those in FIG. 7.

(1) Casing

In the present embodiment, a casing 210 has a trunk casing part 211 onto which an intake tube 219 is hermetically fitted, as well as an upper wall part 212 onto which a discharge tube 220 is hermetically fitted at an upper surface thereof. Refrigerant is guided to the interior of the casing 210 via the intake tube 219, compressed by the compression mechanism 215, and discharged to the exterior of the casing 210 via the discharge tube 220.

(2) Compression Mechanism

In the present embodiment, a fixed scroll component 224 of a compression mechanism 215, as is illustrated in FIG. 11, has at an outer peripheral part an upper refrigerant passage 297*a* penetrating through in the vertical direction; and, as is illustrated in FIG. 12, has at the outer peripheral part an upper oil release hole 296*a* penetrating through in the vertical direction. The upper refrigerant passage 297*a* and the upper oil release hole 296*a* communicate with an oil separation space S3. The oil separation space S3 is a space on the interior of the casing 21 which is above the compression mechanism 215. The oil separation space S3 is a space to which refrigerant gas compressed by the compression mechanism 215 is discharged.

The fixed scroll component 224, as is illustrated in FIG. 11, has an interior discharge tube 230. One of the end parts of the interior discharge tube 230 is connected to an opening part on an upper side of the upper refrigerant passage 297*a*, and the other end part is positioned in the oil separation space S3. The interior discharge tube 230, as is illustrated in FIGS. 11 and 13, is an L-shaped tube which is elongated upward in the vertical direction from the opening part of the upper refrigerant passage 297*a*, caused to curve above the oil separation space S3, and elongated in the horizontal direction along a direction tangent to the outer periphery of the casing 210.

(3) Main Frame

In the present embodiment, a main frame 223, as is illustrated in FIG. 12, has a second intercommunicating passage 248. Similarly with respect to the second embodiment, the second intercommunicating passage 248 communicates with the first intercommunicating passage 46 of the compression mechanism 215 on an upper surface of the main frame 223, and communicates with the high-pressure space S1 via the discharge port 49 on a lower surface of the main frame 223. The second intercommunicating passage 248 comprises a frame through-hole 248*a* penetrating through the main frame 223 in the vertical direction, and an intercommunicating space 248*b* between an outer peripheral surface of the main frame 223 and an inner wall surface of the trunk casing part 211, the intercommunicating space 248*b* being positioned below the frame through-hole 248*a*. The frame through-hole 248*a* has at a lower end part a narrowed part 294 where the cross-sectional area reaches a minimum.

The main frame 223, as is illustrated in FIG. 11, has, at an outer peripheral part, a lower refrigerant passage 297*b* penetrating through in the vertical direction, and, as is illustrated in FIG. 12, has a lower oil release hole 296*b* penetrating through in the vertical direction. The lower refrigerant passage 297*b* communicates with an upper refrigerant passage 297*a*, and the lower oil release hole 296*b* communicates with an upper oil release hole 296*a*. The lower refrigerant passage 297*b* and the lower oil release hole 296*b* communicate with the high-pressure space S1 which is below the main frame 223. The lower oil release hole 296*b* is positioned in the vicinity of the frame through-hole 248*a*.

(4) Ejector Mechanism

In the present embodiment, the ejector mechanism 291, as is illustrated in FIG. 12, comprises a refrigerant-accelerating flow path 295*a*, an oil suction flow path 295*b*, and the narrowed part 294. In the present embodiment, the refrigerant-accelerating flow path 295*a* comprises the frame through-hole 248*a* and an intercommunicating space 248*b*. The frame through-hole 248*a* has the narrowed part 294. A space on the interior of the upper oil release hole 296*a* and the lower oil release hole 296*b* forms a part of the oil suction flow path 295*b*. The oil suction flow path 295*b* merges with the refrigerant-accelerating flow path 295*a* in the intercommunicating space 248*b*.

<Operation>

In the present embodiment, as is illustrated in FIG. 11, compressed refrigerant discharged from the compression mechanism 215 into the high-pressure space S1 passes through the lower refrigerant passage 297*b* of the main frame 223 and the upper refrigerant passage 297*a* of the fixed scroll component 224 prior to being discharged to the exterior of the casing 210, and flows into the interior discharge tube 230. Thereafter, the compressed refrigerant is discharged from the interior discharge tube 230 into the oil separation space S3. In a case where the scroll compressor 201 is viewed from above, the compressed refrigerant, as is illustrated in FIG. 13, is discharged at the outer peripheral part of the fixed scroll component 224, along a direction tangent to the outer periphery of the casing 210. The compressed refrigerant discharged spinningly flows in the oil separation space S3 while running along the inner wall surface of the upper wall part 212 of the casing 210. At such a time, the lubricating oil included in the compressed refrigerant is separated out by the centrifugal force created by the spinning flow, and is flung toward the inner wall surface of the upper wall part 212. The lubricating oil, flung out and having stuck to the inner wall surface of the upper wall part 212, falls through the inside of the oil separation space S3, and is released into the high-pressure space S1 from the upper oil release hole 296*a* of the fixed scroll component 224. The compressed refrigerant from which the lubricating oil has been separated out is discharged to the exterior of the casing 210 via the discharge tube 220.

A description of a process in the present embodiment by which the lubricating oil separated out in the oil separation space S3 is returned to the high-pressure space S1 by the ejector mechanism 291 shall now be provided. The refrigerant compressed by the compression mechanism 215, when flowing through the refrigerant-accelerating flow path 295*a*, passes through the narrowed part 294. At such a time, the flow path of the refrigerant is tightened, whereby the flow rate of the refrigerant is increased. A negative pressure is generated, due to the ejector effect, in the oil suction flow path 295*b* merging with the refrigerant-accelerating flow path 295*a*. A suction action from the oil separation space S3 to the oil suction flow path 295*b*, i.e., to the lower oil release hole 296*b* is thereby generated. As such, the lubricating oil separated out from the compressed refrigerant in the oil separation space S3 is sucked into the lower oil release hole 296*b* by way of the upper oil release hole 296*a*, and ultimately arrives at the intercommunicating space 248*b*. Thereafter, the lubricating oil falls through the high-pressure space S1 and is supplied to the oil reservoir P in the bottom part of the casing 210.

<Features>

In the present embodiment, the lubricating oil separated out in the oil separation space S3 is not stored in the bottom part of the oil separation space S3 but rather is rapidly released into the high-pressure space S1 by the ejector mechanism 291. As such, the scroll compressor 201 according to the present embodiment makes it possible to curb any decline in the efficiency at which the lubricating oil is separated out.

Also, in the present embodiment, the lubricating oil is separated out from the compressed refrigerant in the oil separation space S3 inside the casing 210, and accordingly there is no need to install on the exterior of the casing 210 the oil separator 2 used in the second embodiment. As such, the scroll compressor 201 according to the present embodiment makes it possible to reduce costs.

INDUSTRIAL APPLICABILITY

The compressor according to the present invention returns high-temperature lubricating oil separated out by the oil separator to the high-pressure space in the interior of the compressor, making it possible to suppress any decline in volumetric efficiency. As such, employing the compressor according to the present invention in a refrigeration cycle makes it possible to operate an air conditioner or other refrigeration device in an efficient manner.

REFERENCE SIGNS LIST

1, 101, 201 Compressor (Scroll compressor)
2 Oil separator
3 Condenser
4 Expansion mechanism
5 Evaporator
10, 210 Casing
15, 215 Compression mechanism
91, 191, 291 Ejector mechanism
92 First flow-path-forming member (gas guide)
93 Second flow-path-forming member (Constricted-flow plate)
94, 194, 294 Narrowed part
95*a*, 195*a*, 295*a* Refrigerant-accelerating flow path
95*b*, 195*b*, 295*b* Oil suction flow path
96, 196 Oil return passage
123, 223 Main frame
148*a*, 248*a* Through-hole (frame through-hole)
296*b* Oil release hole (lower oil release hole)
S1 High-pressure space
S3 Oil separation space

CITATION LIST

Patent Literature

PATENT LITERATURE 1: Japanese Unexamined Publication No. 5-223074

The invention claimed is:

1. A compressor, comprising:

a casing configured to store lubricating oil in a bottom pan;

a compression mechanism accommodated in an interior of the casing;

an oil separator arranged and configured to separate out the lubricating oil from high-pressure refrigerant discharged from the compression mechanism, the oil separator being installed exterior to the casing;

an oil return passage through which the lubricating oil separated out by the oil separator flows, the oil return passage communicating with a space formed in the interior of the casing and into which the high-pressure refrigerant discharged from the compression mechanism flows such that the lubricating oil separated from high-pressure refrigerant in the oil separator is returned to the space by the oil return passage; and an ejector mechanism formed in the space, the ejector mechanism including a refrigerant-accelerating flow path in which the high-pressure refrigerant flows via a narrowed part in order to increase a flow rate of the high pressure refrigerant, and an oil suction flow path communicating with the oil return passage and merging with the refrigerant-accelerating flow path, the lubricating oil being sucked from the oil return passage into the oil suction flow path.

2. The compressor as set forth in claim 1, wherein the oil suction flow path merges with the refrigerant-accelerating flow path in a substantially parallel manner.

3. The compressor according to claim 1, wherein the refrigerant-accelerating flow path is formed from a first flow-path-forming member forming a flow path for the high-pressure refrigerant together with the casing, and a second flow-path-forming member forming the narrowed part together with the first flow-path-forming member; and the oil suction flow path is formed from the casing and the second flow-path-forming member.

4. The compressor according to claim 1, further comprising a main frame supporting the compression mechanism, the main frame having a through-hole communicating with the high-pressure space and through which the high-pressure refrigerant discharged from the compression mechanism flows, the refrigerant-accelerating flow path including the through-hole having the narrowed part as well as a space formed from the casing and the main frame, and the oil suction flow path including a space formed from the casing and the main frame.

5. The compressor according to claim 2, wherein the refrigerant-accelerating flow path is formed from a first flow-path-forming member forming a flow path for the high-pressure refrigerant together with the casing, and a second flow-path-forming member forming the narrowed part together with the first flow-path-forming member; and the oil suction flow path is formed from the casing and the second flow-path-forming member.

6. The compressor according to claim 2, further comprising a main frame supporting the compression mechanism, the main frame having a through-hole communicating with the high-pressure space and through which the high-pressure refrigerant discharged from the compression mechanism flows, the refrigerant-accelerating flow path including the through-hole having the narrowed part as well as a space formed from the casing and the main frame, and the oil suction flow path including a space formed from the casing and the main frame.

7. A refrigerant device including the compressor according to claim 1, the refrigerant device further comprising:

a condenser, an expansion mechanism, and an evaporator.

* * * * *